US005197745A

United States Patent [19]

Whiteley

[11] Patent Number: 5,197,745

[45] Date of Patent: Mar. 30, 1993

[54] THROWING KNIFE

[76] Inventor: Roger D. Whiteley, 426 S. Leonine St., Wichita, Kans. 67213

[21] Appl. No.: 626,014

[22] Filed: Dec. 12, 1990

[51] Int. Cl.[5] ..... A63B 65/02; B26B 11/00

[52] U.S. Cl. ..... 273/420; 30/123

[58] Field of Search ..... 273/416, 419–423, 273/428; D21/145, 48, 5, 203, 49; D22/118, 115; 30/123, 295; 124/5

[56] References Cited

U.S. PATENT DOCUMENTS

D. 172,821 8/1954 Cass ..... 273/420 X
D. 201,891 8/1965 Hirsch ..... D21/145 X
D. 290,283 6/1987 Glock ..... D22/118
183,759 10/1876 Goodwin ..... D21/145 X
3,772,781 11/1973 Newman ..... 30/123
4,308,849 1/1982 Seregely ..... 124/5

*Primary Examiner*—Paul E. Shapiro
*Attorney, Agent, or Firm*—Edward L. Brown, Jr.

[57] ABSTRACT

The throwing knife including a single blade having a blade point, a root portion connected to a handle having a butt end onto which is attached a cloth tail. Formed at the root portion of the blade are a pair of wing members which extend laterally outward from the plane of the knife on opposite sides for engagement by the index and middle finger of the person throwing the knife.

1 Claim, 1 Drawing Sheet

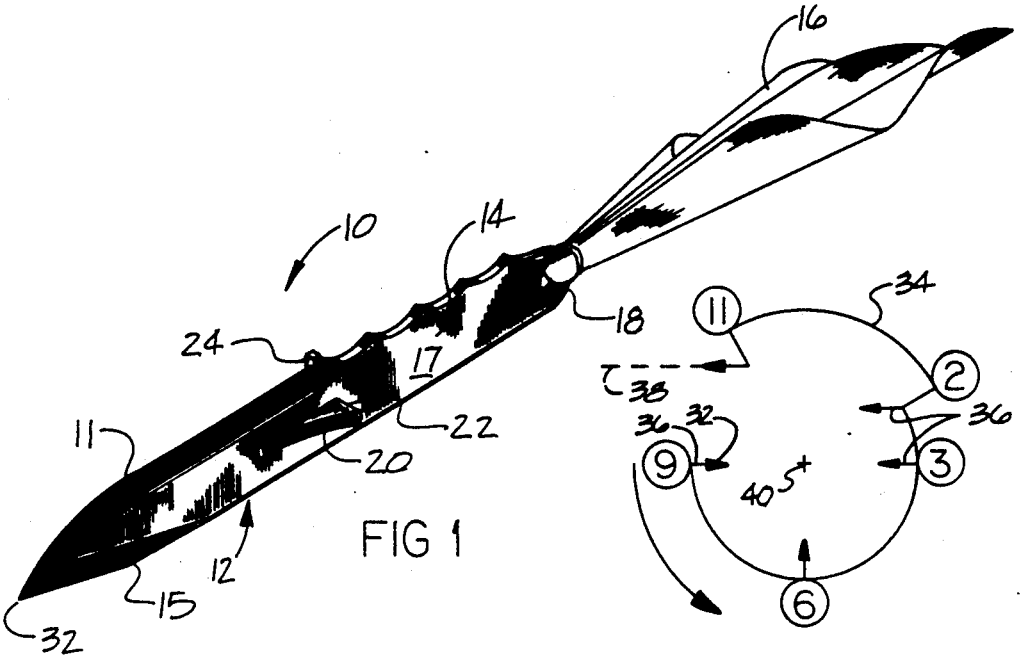
FIG 1
FIG 5
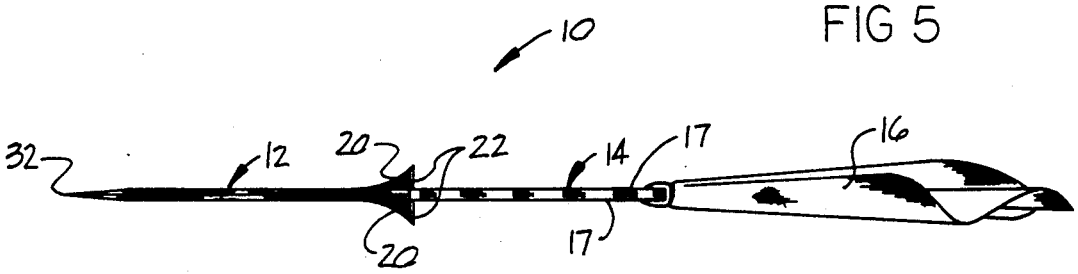
FIG 2
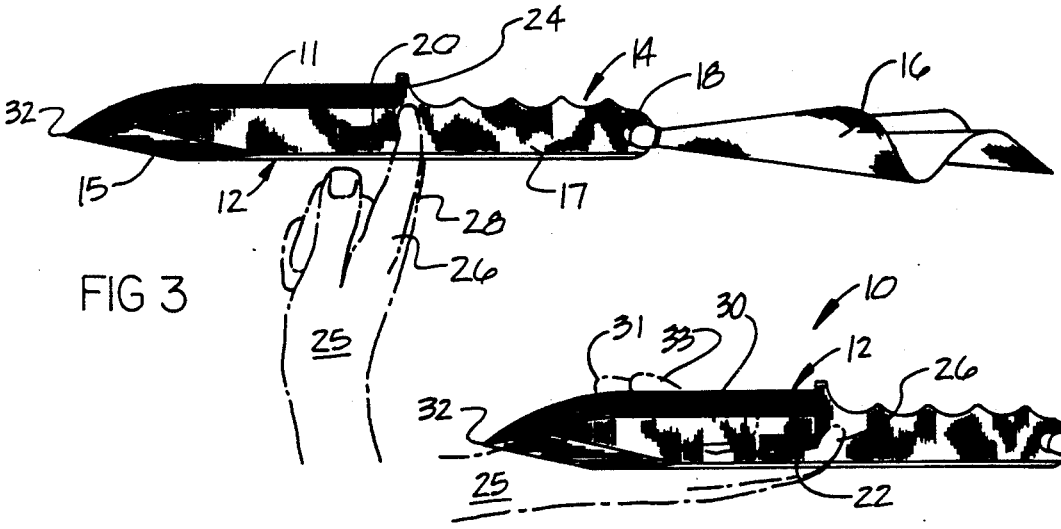
FIG 3
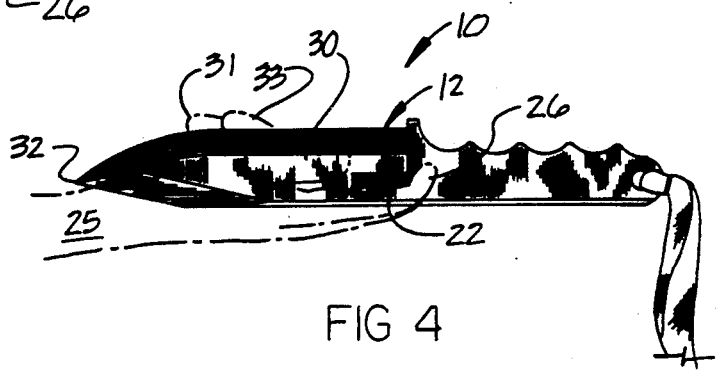
FIG 4

THROWING KNIFE

BACKGROUND OF INVENTION

The invention relates to knives and more specifically to throwing knives which are thrown by an unorthodox method similar to that of throwing a dart.

The knife is one of the oldest utility implements known to man and has been used throughout the centuries not only as a weapon but also as an implement or tool to facilitate eating and preparation of hides. In more modern times, knives have been used by outdoorsmen and soldiers for a variety of functions such as chopping, thrusting, and lastly throwing as a sport. To a very limited degree, thrown knives have been utilized as a weapon in warfare or for the killing of game.

The conventional matter of throwing a knife has been to tumble it through the air at a rotation rate so that when it reaches the target, the knife is point first with the knife axially alined with the path of movement through the air. To achieve a proper throw, the rotation rate must match the distance traveled so that the knife doesn't hit handle first or broad side to the target thrown at. A conventional sporting throwing knife is illustrated in U.S. Pat. No. Des. 269,108 Utilizing knife blades on both ends of the knife allows the thrower to increase his ability to correctly align the blade as illustrated in U.S. Pat. No. 4,608,757 and U.S. Pat. No. Des. 170,824. Alignment accuracy was further enhanced with the throwing knives having four blades or more as illustrated in U.S. Pat. Nos. 4,502,219 and 4,027,389.

The throwing technique of the present invention does not involve tumbling the knife through the air but rather releasing it knifepoint forward aligned with the path on which it is to be thrown. To prevent any tumbling or rotation in flight, a tail or a stabilizing device is attached to its rearend in the same manner as the feathers on an arrow or a conventional dart. Projectiles that are thrown in this manner are taught in U.S. Pat. Nos. 275,236 and 3,772,781. In both of the last mentioned patents the projectile included a spherical ball attached to the shaft of the knife or dart which is engaged by the throwers hand in the same manner as a baseball is gripped and thrown.

SUMMARY OF THE PRESENT INVENTION

While the throwing knife of the present invention is thrown in a somewhat similar manner to that of a dart, the substantial weight of a steel throwing knife cannot be launched with a sufficient force by merely engaging the knife between the index finger and thumb as is done with a dart. The present invention includes a pair of small wing members which extend outwardly on opposite sides of the knife and are engaged by the index and middle finger, approximate the first joint with the remaining fingers of the hand and palm utilized to hold the knife prior to the power stroke of the throw. The thrower initially holds the knife between the index and middle finger with the blade resting in the palm of the hand while the thumb, little finger and ring finger maintain the knife in position in the hand. As the thrower lifts his arm and approaches the final power stroke, the knife remains pointed towards the target while the three support fingers release the knife and it rotates about the contacting surfaces of the wings on the index and middle fingers which provide the essential driving force for throwing the knife. The contacting surfaces of the wings provide a driving surface, through which the index and middle finger throw the knife as well as providing a pivot point for the knife as it rotates relative to the throwing fingers.

By grasping the wings of the knife in this manner, a substantially greater throwing force can be imparted to the knife than the conventional type grip which holds the dart or projectile between the thumb and index finger.

Therefore, the principal object of the present invention is to provide a new and improved throwing knife technique which does not require tumbling the knife through the air but rather launching the knife along a path parallel to the axis of the knife through a pair of unique driving wings driven by the index and middle finger of the throwing hand.

Another object of the present invention is to provide a throwing knife structure capable of transmitting increased throwing forces to the knife than that of the prior art through a unique throwing method.

Another object of the present invention is to provide a throwing knife which is far more accurate in blade alignment with the target than prior methods.

Another object of the present invention is to provide a throwing knife which is highly stabilized in flight so that the knifepoint strikes the target in axial alignment with its flight path.

Another object of the present invention is provide a new and novel knife throwing technique which permits the knife to be thrown more powerfully while retaining accuracy in its flight path.

Other objects of advantage will become obvious to one skilled in the art in light of the following disclosure.

BRIEF DESCRIPTION OF THE DRAWINGS

FIG. 1 is a perspective view of the throwing knife in flight with the tail trailing there behind;

FIG. 2 is a top plan view of the knife as shown in FIG. 1;

FIG. 3 is a side elevational view of the knife just prior to release from the throwing hand;

FIG. 4 is a side view of the knife as it is held by the throwing hand prior to the power stroke; and FIG. 5 is a symbolic representation of the position of the throwing knife at various positions of the throwing arm.

DESCRIPTION OF THE PREFERRED EMBODIMENTS

Referring to FIG. 1, the throwing knife, generally referred to by reference numeral 10, includes a blade 12 and handle portion 14 both cut from a single piece of steel having uniform thickness. Blade 12 includes a cutting edge 11, an unsharpened edge 15 and a knife point 32. The handle 14 has planar side walls 17, as best seen in FIG. 2, with an opening 18 located at the butt end of the handle for receipt of a cloth tail 16 which functions as a stabilizing means during flight of the knife.

Positioned approximate the root portion of blade 12 are a pair of wing members 20 each of which extends laterally outward from the plane of the knife on opposite sides thereof, as seen in FIG. 2. The wing members 20 are tapered forward into the plane of the knife blade while the rear edges thereof provide a contacting surface 22 for the index and middle fingers which impart the throwing force to the knife.

Also positioned midway on the knife 10 is a conventional blade guard 24 extending from the cutting edge 11 of the blade. The wings 20 are positioned approximate the center of gravity of the knife and provide not only a lateral driving surface 22 on the knife but also a hinge point for the fingers to rotate relative to the axis of the knife during the power stroke of the throw.

FIG. 4 illustrates how the knife is initially held with the point 32 directed toward the body of the thrower with the blade 12 resting in the palm of the hand between the index and middle fingers 26 and 28 accordingly. The thumb 30 along with the little finger 31 and ring finger 33 assist in retaining the knife in place.

THROWING METHOD

While FIG. 4 illustrates the initial manner in which the knife 10 is held, FIG. 3 illustrates the position of the hand 25 just prior to release of the knife along its trajectory. FIG. 5 is a symbolic illustration of the various positions of the knife and throwing arm from its initial aiming position through counterclockwise rotation of the throwing arm from its 9 o'clock aiming position through its 11 o'clock releasing position at the end of the power stroke 34. In viewing FIG. 5, consider the center point 40 of the circle as the pivot point of the thrower's shoulder as his arm moves from the 9 o'clock position counterclockwise to the 11 o'clock release position. In the initial aiming position, the thrower's arm is aimed at the target, in the 9 o'clock position, with the knife point pointed away from the target and towards the thrower, as symbolically shown. As the thrower begins his throwing motion, his arm swings downward towards the 6 o'clock position wherein the point of the knife 32 still remains pointed toward the thrower's shoulder, as illustrated in FIG. 4. The thrower's arm continues its upswing from the 6 o'clock position to the 3 o'clock position with the knife point still pointed at the thrower's shoulder pivot point 40. At the 3 o'clock position, the knife is now parallel to the trajectory path 38 and as the thrower's arm continues from the 2 o'clock position (beginning of power stroke 34), the angular position of the throwing knife 10 to the thrower's arm begins to change from its FIG. 4 position, which is at 3 o'clock, to its FIG. 3 position at 11 o'clock just prior to release of the knife. As you can see by viewing FIGS. 4 and 3, the arm and wrist of the thrower were basically parallel to the axis of the knife in the FIG. 4 position while the arm and wrist begin to rotate away from the axis of the knife, as seen in the FIG. 3 position. Through this transition, the thrower releases the front portions of the blade held by fingers 30, 31 and 33 while the knife 10 pivots about the contacting surface 22 with the index and middle fingers 26 and 28. Fingers 26 and 28 engage the wing members 20 at some point between the finger tip and the first joint of the fingers 26 and 28. At the beginning of the power stroke 34 which is approximately the 2 o'clock position, as seen in FIG. 5, the thrower's arm is rotating and the wrist and driving fingers begin to snap. The combined action of the wrist snap and arm rotation provides a maximum thrust to the knife through the two lateral surfaces 22 on the wing members 20. Throughout the power stroke of the throw from the 2 o'clock position to the 11 o'clock position, the thrower maintains the knife 10 in a position parallel with the trajectory 38 even though the angular position between the knife axis and the thrower's hand is changing. At approximately the 11 o'clock position, the knife 10 is released by index and middle fingers 26 and 28 which are the only remaining contacts with the knife. The knife 10 continues on its trajectory 38 towards the target and if the knife is misaligned at the release point, the tail 16 will stabilize the knife 10 along its trajectory so that the knife does not tumble and is aligned with its trajectory upon impacting with the target. The size of the tail cloth 16 can be varied in length, width and thickness of cloth to fit the particular thrower's requirements. A beginning thrower, of course, desires a stronger stabilizing force since he is more likely to release the knife in a non-aligned position, however, the greater the stabilizing force, the more drag that is applied throughout its trajectory. In other words, the greater the drag the less distance you can throw the knife. For the particular thrower, the optimum size for the tail cloth 16 would be as small as possible while providing enough stabilizing effect to prevent the knife from tumbling during flight.

The throwing knife 10 is fabricated from a single piece of steel of approximately a quarter inch in thickness and has a weight in the vicinity of one pound. The lateral positioning of the wings 20 are axially aligned approximately with the center of gravity of the knife so as not to create any rotative moments to the knife during the power stroke when the stabilizing fingers are not restraining the knife's rotation. With the longitudinal axis of wings 20 passing through the center of gravity of the knife, the driving fingers 26 and 28 will apply no rotative moments to the overall knife 10.

Many variations and modifications of this knife will become apparent to those skilled in the art, and it should be understood that the invention is not to be limited by the foregoing description, but is limited only by the scope of the appended claims.

I claim:

1. The method of throwing a knife having a pointed blade and pair of wings including the following steps:

positioning a hand in a starting position, gripping the knife in the hand with the knife gripped between the index and middle finger of the throwing hand with the blade resting on the palm and finger tips of the index and middle fingers contacting a bearing surface of the wings with the blade point pointed at the thrower;

rotating the throwing arm and knife through a power stroke to a release position while rotating the throwing hand relative to the knife about the wings so that during the power stroke the knife is point-first just prior to release;

driving the knife through the power stroke with the index and middle fingers only in contact with the wings just prior to release.

* * * * *